US006421857B2

(12) United States Patent
Whatman et al.

(10) Patent No.: US 6,421,857 B2
(45) Date of Patent: Jul. 23, 2002

(54) LINER FOR AN INFANT BED

(76) Inventors: Susan L. Whatman, 53 Drapers Road, Eatons Hill, Queensland (AU), 4037; Tracey L. Blanch, 29 Meagan Street, Kenmore, Queenland (AU), 4069

( * ) Notice: Subject to any disclaimer, the term of this patent is extended or adjusted under 35 U.S.C. 154(b) by 0 days.

(21) Appl. No.: 09/733,941

(22) Filed: Dec. 12, 2000

(30) Foreign Application Priority Data

Dec. 13, 1999 (AU) ..... 65256/99

(51) Int. Cl.[7] ..... A47D 15/00; A47C 21/08

(52) U.S. Cl. ..... 5/663; 5/93.1; 5/424; 5/427; 5/922; 5/946

(58) Field of Search ..... 5/93.1, 424, 425, 5/426, 427, 482, 496, 497, 499, 658, 663, 922, 946

(56) References Cited

U.S. PATENT DOCUMENTS

| | | | | | |
|---|---|---|---|---|---|
| 2,128,978 | A | * | 9/1938 | Akin | 5/93.1 |
| 3,018,492 | A | * | 1/1962 | Rosen | 5/93.1 |
| 3,137,870 | A | * | 6/1964 | Fink | 5/93.1 |
| 3,321,779 | A | * | 5/1967 | Kaufman et al. | 5/93.1 |
| 3,430,272 | A | * | 3/1969 | Thorn, Jr. | 5/93.1 |
| 3,619,824 | A | * | 11/1971 | Doyle | 5/143 |
| 3,877,090 | A | * | 4/1975 | Schutz | 5/93.1 |
| 4,370,765 | A | * | 2/1983 | Webber | 5/427 |
| 4,670,923 | A | * | 6/1987 | Gabriel et al. | 5/424 |
| 5,010,611 | A | * | 4/1991 | Mallett | 5/497 |
| 5,153,954 | A | * | 10/1992 | Ohman | 5/93.1 |
| 5,241,718 | A | * | 9/1993 | Pope | 5/424 |
| 5,410,765 | A | * | 5/1995 | Dicken | 5/93.1 |
| 5,421,046 | A | * | 6/1995 | Vande Streek | 5/946 X |
| 5,542,135 | A | * | 8/1996 | Ozrovitz et al. | 5/424 |
| 5,577,276 | A | * | 11/1996 | Nicholson et al. | 5/922 X |
| 5,706,534 | A | * | 1/1998 | Sherman | 5/424 |
| 5,806,112 | A | | 9/1998 | Harms | 5/93.1 |
| 5,881,408 | A | | 3/1999 | Bashista et al. | 5/663 |
| 5,926,873 | A | * | 7/1999 | Fountain | 5/424 |
| 5,933,885 | A | | 8/1999 | Glassford | 5/424 |
| 5,937,458 | A | * | 8/1999 | DeRosa | 5/424 |
| 5,960,493 | A | * | 10/1999 | Rhey et al. | 5/424 |
| 6,026,528 | A | * | 2/2000 | Pina | 5/658 |
| 6,055,690 | A | * | 5/2000 | Koenig | 5/93.1 X |
| 6,131,216 | A | * | 10/2000 | Pine | 5/93.1 |
| 6,170,101 | B1 | * | 1/2001 | McCloud | 5/424 |
| 6,178,573 | B1 | * | 1/2001 | Wagner et al. | 5/424 |
| 2001/0037526 | A1 | * | 11/2001 | Whatman et al. | 5/663 |

FOREIGN PATENT DOCUMENTS

| | | | | |
|---|---|---|---|---|
| GB | 795742 | * | 5/1958 | 5/427 |

* cited by examiner

*Primary Examiner*—Robert G. Santos
(74) *Attorney, Agent, or Firm*—Nixon & Vanderhye P.C.

(57) ABSTRACT

A liner which is attachable to an infant bed of the type having side walls to prevent the infant from falling out of the bed, the liner having one or more breathable side walls which, in use, extend about the inside walls of the bed, an open top, top attachment means to attach the liner to an upper part of the side walls of the bed, a generally open bottom, and bottom attachment means to attach the liner to a bottom part of the bed and/or the bed mattress.

8 Claims, 2 Drawing Sheets

LINER FOR AN INFANT BED

This invention relates to a liner for an infant bed, the bed being of the type having side walls to prevent the infant from falling out of the bed. These types of infant beds typically include cots, bassinets, cribs and cradles. It is envisaged that the invention can also extend to playpens. The invention will be described with reference to a cot but it should be appreciated that the invention is applicable to related types of infant beds.

BACKGROUND AND SUMMARY OF THE INVENTION

Baby cots are typically rectangular in shape and have a bottom wall, four side walls and an open top. A soft mattress is placed in the cot and is supported by the bottom wall. One side wall of the cot can drop down to provide easier access to and from the cot. The side walls are not solid and are typically formed of an array of vertical rails or palings to provide air flow and allow the baby to be seen through the side walls of the cot. The spacing between the side wall rails is such to prevent a baby from pushing through the rails. However, the rails are typically sufficiently spaced apart to allow a baby's hand or leg to pass through the gap. There are many recorded instances of injuries to babies by becoming wedged or stuck between the side wall rails.

It is known to provide cot bumpers which are usually placed around the periphery of the mattress and can be loosely tied onto the side wall rails and which provide a cushioning against the baby striking themselves on the hard rails when sleeping. However, these bumpers restrict the air flow around the infant and can prevent the parents from seeing the position of the infant unless they are standing over the cot.

The cot gaps often result in infants having their arms and legs caught through the gap as they sleep, and by being restricted in this way, the infant usually awakes interrupting the quality of their (and the parents) sleep.

Another disadvantage with cot bumpers and the like is that they are loosely tied to the cot rails, and older babies, being naturally busy and inquisitive, can usually fiddle with the ties to make them loose.

The present invention is directed to a liner for a cot and other related types of infant beds (e.g. cribs and bassinets) which prevents a baby's legs or arms from passing between the side wall rails, is breathable, and which is relatively easy to attach to the cot.

It is an object of the invention to provide a liner which may overcome the abovementioned disadvantages or provide the public with a useful or commercial choice.

In one form, the invention resides in a liner which is attachable to an infant bed of the type having side walls to prevent the infant from falling out of the bed, the liner being constructed from substantially soft materials and comprising one or more breathable side walls that are permanently fixed relative to each other, wherein the side walls, in use, extend about the inside of the side walls of the bed so as to substantially cover the inside of the side walls of the bed; a generally open bottom; bottom attachment means adapted to attach the liner to a bottom part of the bed or a mattress; an open top; and top attachment means adapted to attach the liner to a substantially horizontal upper portion of the side walls of the bed, wherein the top attachment means, which is unpadded and substantially childproof, comprises a first band of hook or loop material from a hook and loop type fastener, wherein the first band extends about the outside of the liner and is adjacent an upper edge thereof; a plurality of straps which, in use, pass over a top horizontal rail of the bed and are attached to the first band to secure the liner to the bed; and a second band of hook or loop material which overlies the straps and is attached to the first band.

In a more particular form, the invention resides in the liner as described above wherein the one or more side walls are formed of a mesh material, the mesh having a mesh size which is small enough to prevent a baby's arms and legs from passing through the mesh, the bottom attachment means comprising elastic on a lower edge of the liner and which, in use, attaches to the mattress to hold the liner to the mattress.

The liner is attachable to a cot, bassinet, crib and similar types of infant beds of the type having side walls. The liner has one or more side walls which are breathable and which in use extend about the inside walls of the bed. Suitably, the liner is sewn into a generally rectangular shape or a shape which can be inserted into a cot to conform generally to the inside shape of the cot.

The liner has breathable side walls, and it is preferred that all the walls of the liner are breathable. The breathable side walls are preferably formed from a mesh material which is sufficiently open to provide good air flow and also to allow the baby to be viewed through the side wall, but sufficiently closed to prevent the baby from passing an arm, leg or even a finger through the mesh. The liner may be formed from a strong mesh material. While not being limiting to the invention, these materials may include woven or non-woven fabrics, nylons, other types of plastic threads, composite threads, a canvas weave, liners made from cotton, rayon, mixtures of fibres and composites.

The open top of the liner allows a baby to be easily placed into and removed from the cot. It is envisaged that the top of the liner may be overlaid with a mosquito net or other type of protective material.

Typically, infant beds such as cots, bassinets and the like have a top horizontal rail and the top attachment means can be attached about this rail. In particular, the straps of the top attachment means may pass about the rail. An array of straps may be provided to ensure that the liner does not appreciably sag about the top of the cot.

The second band functions to minimize the natural inquisitiveness of babies and fiddling by babies of the straps. In essence, the straps are sandwiched between the first and second bands. It is considered that this arrangement results in it being almost impossible for a baby to fiddle with and top open the straps.

In order to minimise the natural inquisitiveness of babies and fiddling by babies of the straps, a second Velcro™ band may be attached over the top of the straps and the Velcro™ band which is adjacent the upper edge of the liner, in essence to sandwich the straps between two Velcro™ bands. It is considered that this will be almost impossible for a baby to fiddle with and to open the straps.

The straps can be length adjustable by various suitable means to make a single liner suitable for various different types of infant beds.

The bottom attachment means attaches the liner to the bed or the mattress in such a way that the bottom of the liner cannot be readily lifted up.

In one form, the bottom edge of the liner may be elasticised to elastically fit around the bed mattress (in a manner analogous to a fitted sheet) to provide a measure of attachment of the liner to the bottom area of the cot. If desired, one or more straps may extend underneath the mattress to more firmly secure the liner to the mattress. Alternatively, or in addition to the above, the liner may also be fastened to the bottom wall of the cot or to some other lower area of the cot.

BRIEF DESCRIPTION OF THE DRAWINGS

An embodiment of the invention will be described with reference to the following drawings in which.

DETAILED DESCRIPTION OF THE INVENTION

Figure 1:
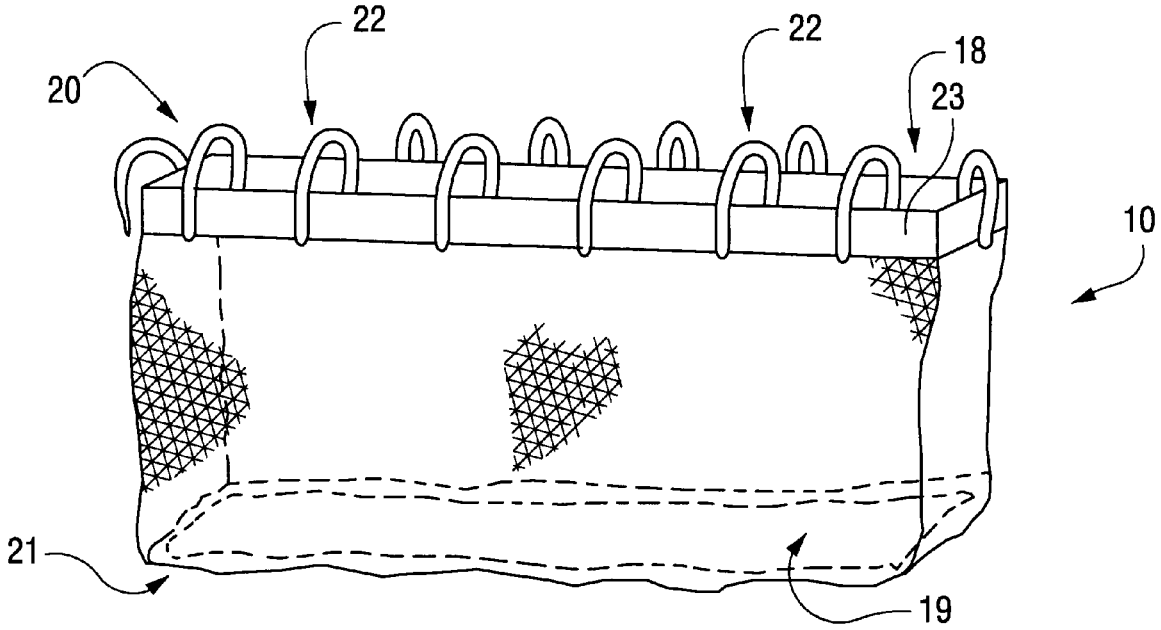
FIG. 1 illustrates a liner prior to insertion into a cot.
Figure 2:
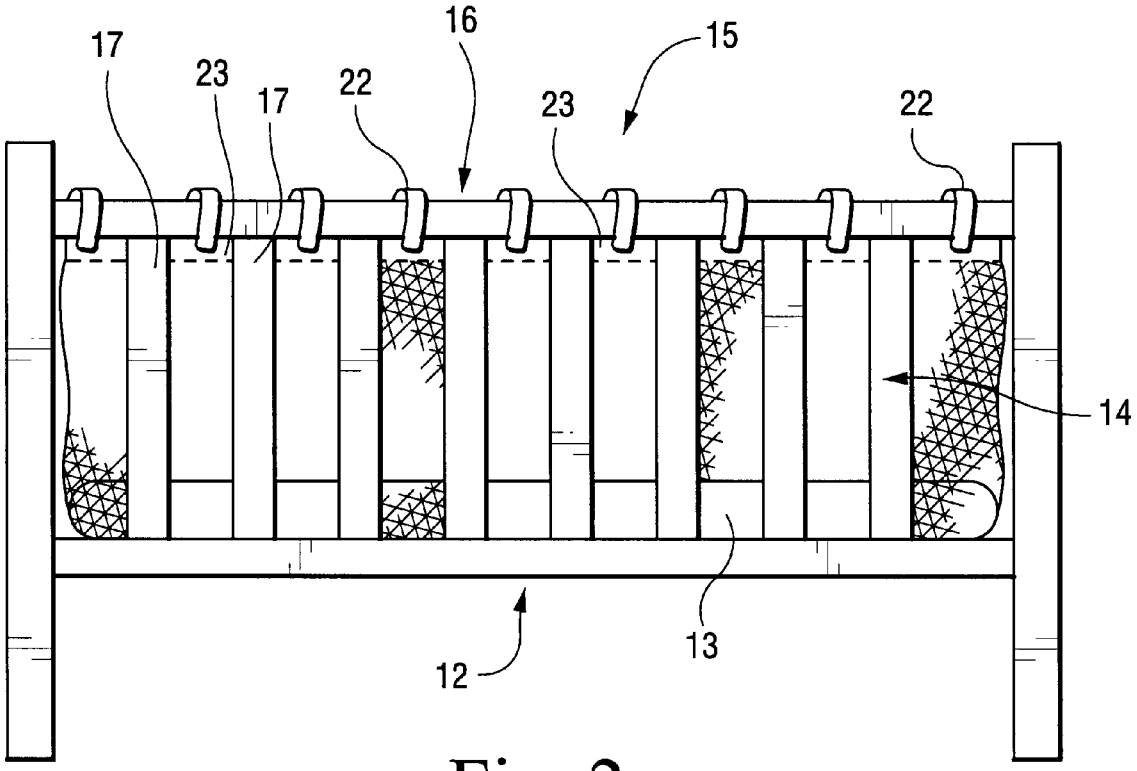
FIG. 2 illustrates the liner in a cot.

Referring to the drawings, there is illustrated a liner 10 which is attachable to an infant bed such as a cot. A typical cot 11 is illustrated in FIG. 2 and consists of a bottom wall 12, a mattress 13 placed on the bottom wall, four side walls 14 (only one illustrated in FIG. 2) and an open top 15. Such cots are well-known in the art. The side wall 14 of the cot is formed with a top rail 16 and an array of spaced apart vertical bars 17.

Liner 10, in the embodiment, is in the form of a rectangular cross-section tube having an open top 18 and an open bottom 19. The liner is formed of an open mesh weave having a mesh size of typically up to 10 mm which prevents a baby's arm, leg or finger from passing through the mesh but still provides good air flow and allows a parent to see the baby through the mesh material.

The liner has an upper peripheral edge 20 and a lower peripheral edge 21.

At the upper edge 20 is a top attachment means which attaches the liner to the top rail 16 of cot 11. The top attachment means comprises a plurality of length adjustable straps 22 which can be formed of canvas or other sturdy material. One edge of the straps is sewn or otherwise attached to the upper edge 20 of the liner. The other end of each strap has a Velcro™ patch (not illustrated). On the outside wall of the liner and at the upper edge 20 is a band of Velcro™ material 23 which extends entirely about the upper edge 20 of the liner.

In use, the liner can be opened up and inserted into cot 11 and the straps 22 can be passed about top rail 16 with the free ends of the strap containing a Velcro™ patch which attaches to Velcro™ band 23 to secure the liner to rail 16.

Figure 3:
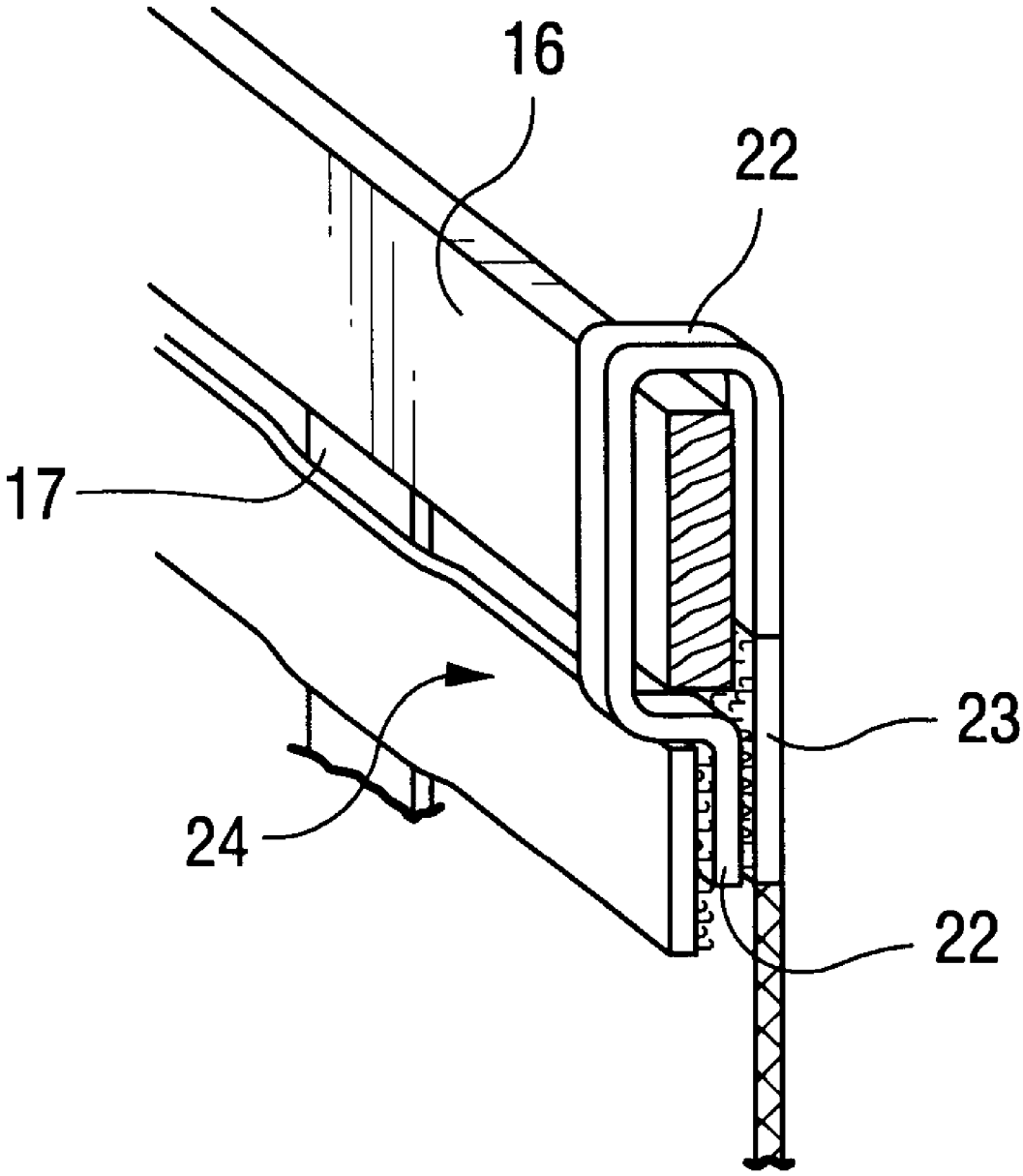
FIG. 3 is a part view of a secure top attachment means according to an embodiment of the invention.

To prevent inquisitive babies from attempting to rip open straps 22, there is provided a second Velcro™ band 24 (see FIG. 3) which extends generally over and is attached to Velcro™ band 23 and effectively sandwiches the ends of each strap 22 between the two Velcro™ bands. Velcro™ band 24 can extend the entire length of the cot side wall, and it is virtually impossible for a baby to attempt to rip open Velcro™ band 24 because of its good contact with Velcro™ band 23. Velcro™ band 24 runs over the outside of bars 17 and attaches to Velcro™ band 23 in the spacing between the bars.

The liner has an open bottom 19 and is provided with a bottom attachment means to attach the liner to a bottom part of the bed and/or the bed mattress. In the embodiment, the lower edge 21 of the liner is elasticised and can elastically fit about the bottom of mattress 13 in a manner analogous to a fitted bed sheet.

Alternatively, or in addition thereto, the lower edge may be otherwise attached to the cot. If desired, one or more under mattress bands or straps may be provided (not illustrated) to further secure the liner to the lower part of the cot.

The mesh cot liner prevents the infant's head, arms, legs, fingers and toes from becoming caught between the gaps in the side walls of the cot. The liner does not restrict air flow around the infant allowing natural cooling breezes to flow around in warm weather. The parents can view the sleeping position of the infant from a distance without having to stand over the cot, which might awake the infant in many cases.

The liner can be adjustable to suit most standard cots. It is held firmly in place by the mattress at the bottom of the cot, tensioned by elastic, and is attached securely to the top rail of the cot by the adjustable straps and the fastening tape.

It should be appreciated that various other changes and modifications may be made to the embodiment described without departing from the spirit and scope of the invention as claimed.

The claims defining the invention are as follows:

1. A liner which is attachable to an infant bed of the type having side walls to prevent the infant from falling out of the bed, the liner being constructed from substantially soft materials and comprising:

one or more breathable side walls that are permanently fixed relative to each other, wherein the side walls, in use, extend about the inside of the side walls of the bed so as to substantially cover the inside of the side walls of the bed;

a generally open bottom;

bottom attachment means adapted to attach the liner to a bottom part of the bed or a mattress;

an open top; and top attachment means adapted to attach the liner to a substantially horizontal upper portion of the side walls of the bed, wherein the top attachment means, which is unpadded and substantially childproof, comprises:

a first band of hook or loop material from a hook and loop type fastener, wherein the first band extends about the outside of the liner and is adjacent an upper edge thereof;

a plurality of straps which, in use, pass over a top horizontal rail of the bed and are attached to the first band to secure the liner to the bed; and a second band of hook or loop material which overlies the straps and is attached to the first band.

2. The liner of claim 1, wherein the one or more side walls are formed of a mesh material, the mesh having a mesh size which is small enough to prevent a baby's arms and legs from passing through the mesh.

3. The liner of claim 1, wherein the bottom attachment means comprises elastic on a lower edge of the liner and which, in use, attaches to the mattress to hold the liner to the mattress.

4. The liner of claim 1, wherein all of the side walls are breathable.

5. The liner of claim 1, wherein the liner has a shape that enables the liner to conform generally to the inside shape of the infant bed.

6. The liner of claim 1, wherein the length of one or more of the plurality of straps can be adjusted.

7. The liner of claim 1, wherein each one of the plurality of straps is attached to the upper edge.

8. The liner of claim 1, wherein the bottom attachment means comprises one or more straps attached to the liner which, in use, extend underneath the bed or mattress.

* * * * *